US010590651B2

(12) United States Patent
Parish

(10) Patent No.: US 10,590,651 B2
(45) Date of Patent: Mar. 17, 2020

(54) PIN CAP

(71) Applicant: Warren E. Parish, Burley, ID (US)

(72) Inventor: Warren E. Parish, Burley, ID (US)

( * ) Notice: Subject to any disclaimer, the term of this patent is extended or adjusted under 35 U.S.C. 154(b) by 0 days.

(21) Appl. No.: 15/633,948

(22) Filed: Jun. 27, 2017

(65) Prior Publication Data

US 2018/0371756 A1 Dec. 27, 2018

(51) Int. Cl.
*E04B 1/38* (2006.01)
*E04C 5/16* (2006.01)
*B21D 53/36* (2006.01)

(52) U.S. Cl.
CPC ..... *E04C 5/161* (2013.01); *B21D 53/36* (2013.01)

(58) Field of Classification Search
CPC ..... E04C 5/161; B21D 53/36
USPC ..... 52/711, 698, 712
See application file for complete search history.

(56) References Cited

U.S. PATENT DOCUMENTS 991,736 A 5/1911 Minnick
1,053,255 A * 2/1913 Ward ..... H01Q 1/1221 248/208
2,060,390 A 11/1936 Adams
2,472,654 A 6/1949 Engelke
2,579,685 A * 12/1951 Loose ..... B65D 19/385 108/53.5
2,814,840 A 12/1957 Sears
3,300,930 A 1/1967 Weise
3,688,937 A * 9/1972 Ellison ..... B65D 19/08 206/527
3,944,177 A 3/1976 Yoda
4,033,534 A 7/1977 Bergkvist
4,136,985 A * 1/1979 Taul ..... B60R 21/131 280/756
4,147,008 A 4/1979 Eisner
4,168,423 A 9/1979 Gilreath
4,560,126 A * 12/1985 Judkins ..... F16L 3/1218 248/72
4,641,478 A * 2/1987 Nelson, Jr. ..... E04H 12/22 52/700
4,723,749 A 2/1988 Carraro et al.
4,756,641 A 7/1988 Hartzheim
5,400,562 A 3/1995 Bahr
5,699,642 A 12/1997 McDevitt, Jr.
5,762,300 A 6/1998 Sorkin
5,878,546 A 3/1999 Westover
5,937,609 A * 8/1999 Roth ..... E04B 1/4121 52/698
6,112,494 A 9/2000 Hardy, Jr. et al.
6,212,848 B1 4/2001 Cooper
6,508,440 B2 1/2003 Schmidt
6,572,058 B1 6/2003 Gerardo
6,837,017 B2 1/2005 Hardy, Jr. et al.
D529,794 S * 10/2006 Murray ..... D8/396
(Continued)

*Primary Examiner* — Basil S Katcheves
(74) *Attorney, Agent, or Firm* — Jason P. Webb; Pearson Butler

(57) ABSTRACT

A stamped pin cap and method of manufacturing the same. There is a frame coupling together a mount, a stop flange and a cradle. The mount couples to a reinforced bar (rebar) as used in construction and the cradle receives a construction pipe, thereby coupling the construction pipe to the rebar. The cradle, in cooperation with the stop flange may mount to lumber. The stamped pin cap requires no welding or expensive molded materials and thereby may be produced cheaply and quickly.

5 Claims, 12 Drawing Sheets

(56) References Cited

U.S. PATENT DOCUMENTS

| | | | | |
|---|---|---|---|---|
| D534,418 | S * | 1/2007 | Minor | D8/354 |
| 7,267,307 | B2 * | 9/2007 | Bauer | F16L 3/223 248/65 |
| 7,452,157 | B2 * | 11/2008 | Deciry | H02G 3/0443 174/64 |
| 7,584,585 | B2 * | 9/2009 | Kilby | E04C 5/206 52/677 |
| 7,963,392 | B2 * | 6/2011 | Kodi | E04C 5/167 206/340 |
| 8,397,464 | B2 * | 3/2013 | Lin | E04B 1/4157 52/701 |
| 9,453,594 | B2 * | 9/2016 | Fiebich | F16L 3/237 |
| 2003/0070388 | A1 * | 4/2003 | Catani | E04C 5/16 52/677 |
| 2006/0273226 | A1 * | 12/2006 | Jatzke | F16L 3/223 248/68.1 |
| 2007/0011985 | A1 | 1/2007 | Kilby | |

* cited by examiner

PIN CAP

BACKGROUND OF THE INVENTION

Field of the Invention

The present invention relates to construction materials, specifically to pin caps generally used with reinforcing bars (rebars).

Description of the Related Art

Concrete is used extensively in the construction industry for a wide variety of construction projects including but not limited to commercial buildings, family dwellings, flooring, pavement, and the like and combinations thereof. As non-limiting examples, concrete footers are used for basements and garage floors, and concrete is generally the major material used for constructing foundations, walls, and floors in many buildings.

To add greater stability and strength, concrete is typically poured over metal reinforcing bars (rebars) that are often in a grid pattern. To produce a quality product, it is important that the rebars be positioned and oriented properly and consistently. Sometimes the rebars are also used to guide processing of the concrete, such as but not limited to providing a height guide for shaping a top surface of the concrete.

To form a grid pattern, or other pattern, with rebar workers generally tie the rebar securely in place in association with grade stakes that are used to mark correct height(s) and width(s) for the concrete when the concrete is poured. This tying process is time consuming and laborious.

Concrete utilization is not the only use of rebars and other similar structures, however it is very prevalent. There are other situations where support structures, including but not limited to rebars, are used, either alone or in conjunction with other support structures, in construction, installation, and fabrication projects. Such support structures, if merely tied together, are typically expensive to produce and tend to be of poor quality, either initially or over time as ties fail/droop/etc.

In the related art, it has been known to use various structures to couple rebars to each other and to other objects. Various clips, hooks, clamps, and tics are used to different effect. Also, pin caps are used to cap a rebar (generally at a top of a vertically oriented rebar) and may include structures for allowing other rebar and/or other structures to couple thereto or lay thereacross. While these devices require additional materials and training on their used, they generally reduce the overall cost of the project and increase the speed and efficiency of aspects of the project that include rebar. Further, they will often increase the consistency of the grid thereby improving the quality of the final product.

Some improvements have been made in the field. Examples of references related to the present invention are described below in their own words, and the supporting teachings of each reference are incorporated by reference herein:

U.S. Pat. No. 2,060,390, issued to Adams, discloses a pair of alike plates each provided-with curved ears between which the hose is positioned and a support member to which the plates are attached. The support member is provided with a ground penetrating. point for positioning it in an upright position. The ears are arranged so that when the hose is twisted it may be inserted between such bars, but after it has been straightened out it is held securely thereby.

U.S. Pat. No. 4,168,423, issued to Gilreath, discloses a support leg for a heating element of an electric unit including vertically extending arm members including inwardly extending teeth members which firmly engage the outer surface of the heating element in a manner to prevent subsequent rotation of such support leg.

U.S. Pat. No. 4,560,126, issued to Judkins et al., discloses a conduit support bracket useful in supporting conduit, cable, piping or the like, especially above a dropped ceiling is disclosed. The conduit support bracket comprises a strip of rigid material having engaging means extending from one end to securely engage a T-bar, fixture or other support structure. This engaging means is preferably provided by a plurality of prongs bent and rebent in oppositely inclined directions. The conduit support bracket further comprises a plurality of deformable tabs extending from the opposite end of the rigid strip. At least one of these deformable tabs is shaped to form a channel between itself and the remaining tabs. This channel is of sufficient size and strength to support the conduit or the like. The remaining deformable tabs are of sufficient length to securely hold the conduit in place when deformed, preferably manually, at least partially around the conduit.

U.S. Pat. No. 4,723,749, issued to Carraro et al., discloses a construction fastener and more specifically to a clamp or clip for securing a horizontally extending channel to another horizontally or vertically extending construction element of miscellaneous configuration. The fastener is formed from a strip of resilient metal or spring steel and at least one end includes a notched portion for engaging a horizontally extending channel. The notched portion is oriented with respect to the horizontal channel such that the longitudinal planar surface of the notched portion is normal to the horizontal axis of the channel. The notched portion includes a cam-like spring tab adapted to spring out of the way and to snap back and lock behind the channel when the channel is inserted into the notched portion. The opposite end of the fastener, which may be engaged or disengaged with or without the channel in the notched portion, may comprise a wire or rod receiving notched portion or it may comprise one of a variety of forms capable of engaging vertically or horizontally extending construction elements of miscellaneous configuration.

U.S. Pat. No. 5,762,300, issued to Sorkin, discloses a support apparatus for a tendon-receiving duct including a cradle for receiving an exterior surface of a duct therein and a clamp connected to the cradle and extending therebelow for attachment to an underlying object. The cradle is a generally U-shaped member having a length greater than a width of the underlying object received by the clamp. The cradle includes a pair of arms extending upwardly from a transition structure and arranged for receiving an exterior surface of the duct. The clamp includes a pair of clamp members arranged in generally transverse relationship to a longitudinal axis of the cradle. A second pair of clamp members is connected to the cradle and arranged in planar alignment with the first pair of clamp members. The cradle and the clamp are integrally formed together of a polymeric material. The underlying object to which the clamp is connected is a chair or a rebar.

U.S. Pat. No. 6,112,494, issued to Hardy Jr. et al., discloses an apparatus for fixating and elevating an interconnected rebar lattice having individual longitudinal and transverse rebar intersections for use as support for poured concrete in highway and other construction. The apparatus including a holding portion having an open ended recess with two opposing walls being generally U-shaped. The recess has a longitudinal axis and is sized and shaped to receive a longitudinal rod. An arc-shaped portion extends laterally outward from each opposing wall and perpendicular to the longitudinal axis of the recess. The arc-shaped portion has a transverse axis and is sized and shaped to receive a longitudinal rod. the arc-shaped portion includes a recess and opposing walls with one wall including a snap-type lock. A locking member has a generally arc-shaped portion and includes a snap-type lock for attaching to the arc-shaped portions and engaging with the snap-type lock of the arc-shaped portions. A leg portion extends downwardly from the holding portion. The holding member is adapted to secure the individual longitudinal and transverse rebar intersections of the rebar lattice in a locking relationship while the leg portion holds the interconnected rebar lattice in a preselected elevated position.

U.S. Patent Application Publication No.: 20070011985, by Kilby, discloses rebar support is provided through an arm-type apparatus, which may have a plurality of dimensions for different concrete constructions. A tube in the apparatus is slid over an upright support such as a grade stake to hold the apparatus in place. Multiple instances of the apparatus may thus be placed over multiple stakes to hold rebar in the correct position for the grid pattern required to strengthen the concrete in a particular structure. Rebar may then be quickly and securely snapped into notches on the apparatus without tying or extensive training of personnel. In an embodiment different designs of the apparatus are provided with notches designed to fit rebar of different diameters. In another embodiment snap-out tabs in the notches are used so that one design of the apparatus may be employed with rebar with different dimensions. The apparatus may be Y-shaped to further strengthen the arms.

The inventions heretofore known suffer from a number of disadvantages which include being difficult to manufacture/fabricate, being expensive, being slow to produce/manufacture, requiring welding to produce, being difficult/expensive/bulky to ship, failing to allow for coupling to other objects such as but not limited to lumber, taking up too much space in shipping, being weak, not being of consistent quality, and being likely to fail.

What is needed is a pin cap that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available pin caps. Accordingly, the present invention has been developed to provide a pin cap for use with reinforcing bars.

According to one non-limiting embodiment, there is a stamped pin cap that may be for use with reinforcing bars, comprising one or more of: a cap frame; a stamped mount that may be disposed within a bottom region of the cap frame and/or including three bands that may be alternately protruding laterally from the frame thereby forming a channel therebetween through which a reinforcing bar may be disposed; a stop flange that may be disposed at a top portion of the channel and/or that may be protruding laterally from the frame such that a reinforcing bar disposed through the channel may be prevented from further travel therethrough, and/or a cradle that may be extending from a top region of the frame and/or may be shaped to receive and/or confine a member therein under gravity.

There may be a pair of holes that may be through the cradle at opposite arms thereof such that coupling shafts may be disposed therethrough. There may be a reinforcing groove that may be extending along the frame.

It may be that the three bands that may be adjacent to each other. It may be that the cradle is shaped to receive a circular pipe.

According to another non-limiting embodiment of the invention, there may be a pin cap, comprising one or more of: a cap frame that may have reinforcing grooves therethrough; a plurality of adjacent alternatingly protruding channel guides that may be protruding laterally from the frame such that a channel is formed therebetween through which a reinforcing bar may be disposed; a cradle that may be extending from a top region of the frame and/or may be shaped to receive and/or confine a member therein under gravity; and/or a stop flange that may be disposed at a top portion of the channel and/or a bottom of the cradle and/or may be protruding laterally from the frame such that a reinforcing bar disposed through the channel is prevented from further travel therethrough.

It may be that the cradle is semi-circular such that a pipe having a circular cross section may nestle therein. It may be that the cradle includes a pair of arms that may each include a hole therethrough.

According to still another non-limiting embodiment of the invention, there is a method of manufacturing a pin cap for use in construction comprising the steps of one or more of: stamping one or more of the following into a strip of stampable material, thereby forming a pin cap section: a plurality of alternating channel guides that may be at a bottom end of a predefined pin cap; a stop flange that may be at a top end of a predefined channel that may be formed by predefined alternating channel guides; a cradle that may be at a top end of a predefined pin cap; and/or a frame; and/or decoupling the pin cap section from the strip of stampable material, thereby forming the pin cap.

It may be that the method includes a step of stamping a hole through an arm of the cradle through which a coupling shaft may be disposed. It may be that the method includes a step of stamping a reinforcing groove through the frame. It may be that the method includes a step of making one or more cuts before performing a stamping step, the cuts positioned and oriented to facilitate stamping. It may be that the method includes performing the method in series along the strip of stampable material such that a plurality of pin caps may be stamped therefrom.

It may be that the cradle is shaped to nestle a circular pipe therein. It may be that a center channel guide is taller than each channel guide adjacent thereto. It may be that the step of stamping channel guides includes a step of folding a pin cap to bring channel guides adjacent to each other.

In yet another non-limiting embodiment of the invention, there is a method of manufacturing a pin cap for use in construction comprising the steps of one or more of: stamping one or more of the following into a strip of stampable material, thereby forming a pin cap section: a channel; a stop flange that may be at a top end of the channel; a cradle that may be near the stop flange and/or opposite the channel; and/or a frame that may be disposed about the channel; and/or decoupling the pin cap section from the strip of stampable material, thereby forming the pin cap.

It may be that the method includes a step of stamping a hole through an arm of the cradle through which a coupling shaft may be disposed. It may be that the method includes a step of stamping a reinforcing groove through the frame. It may be that the method includes a step of making one or more cuts before performing a stamping step, the cuts positioned and oriented to facilitate stamping.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
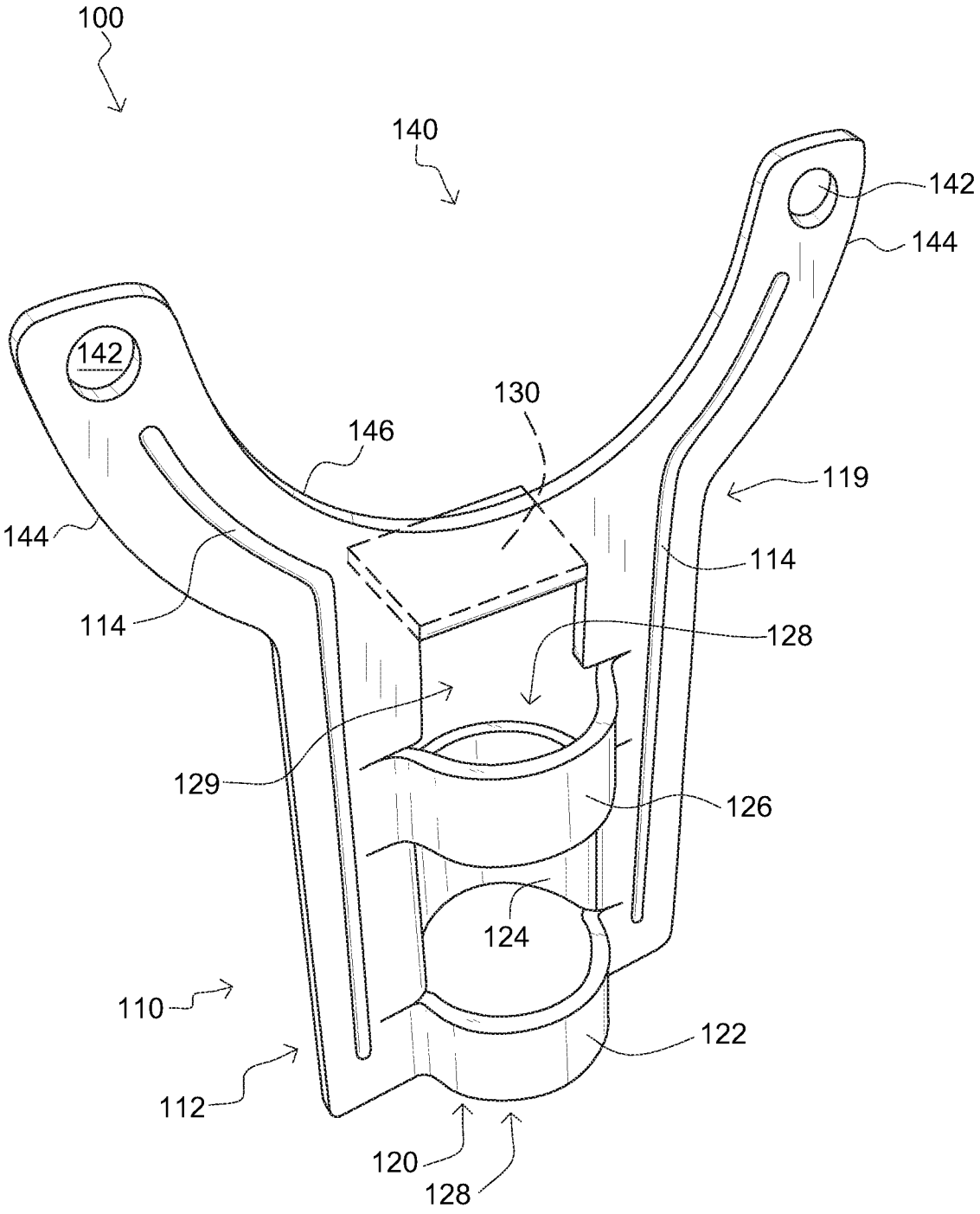
FIG. 1 is a front perspective view of a stamped pin cap according to one embodiment of the invention.
Figure 2:
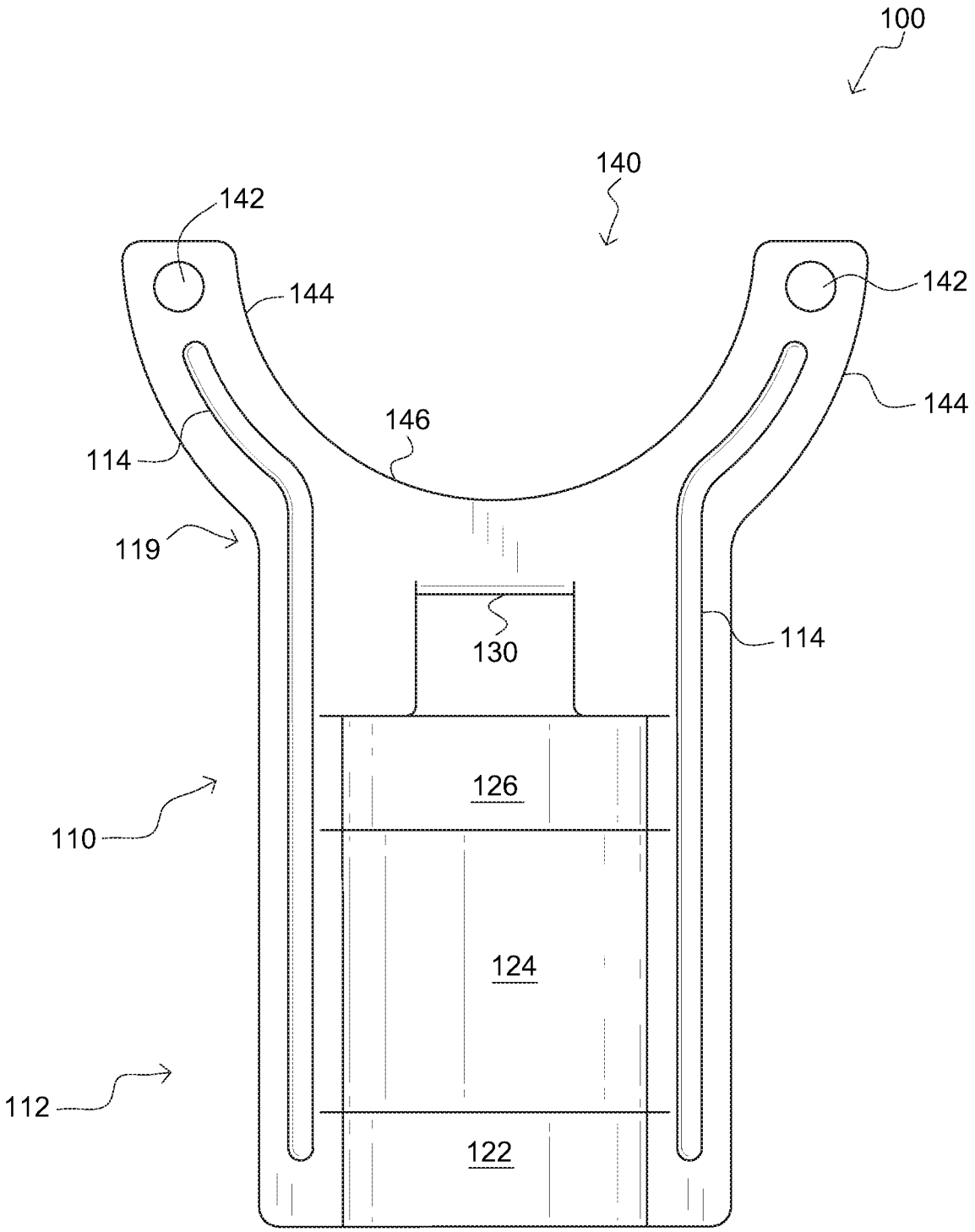
FIG. 2 is a front elevational view of a stamped pin cap according to one embodiment of the invention.
Figure 3:
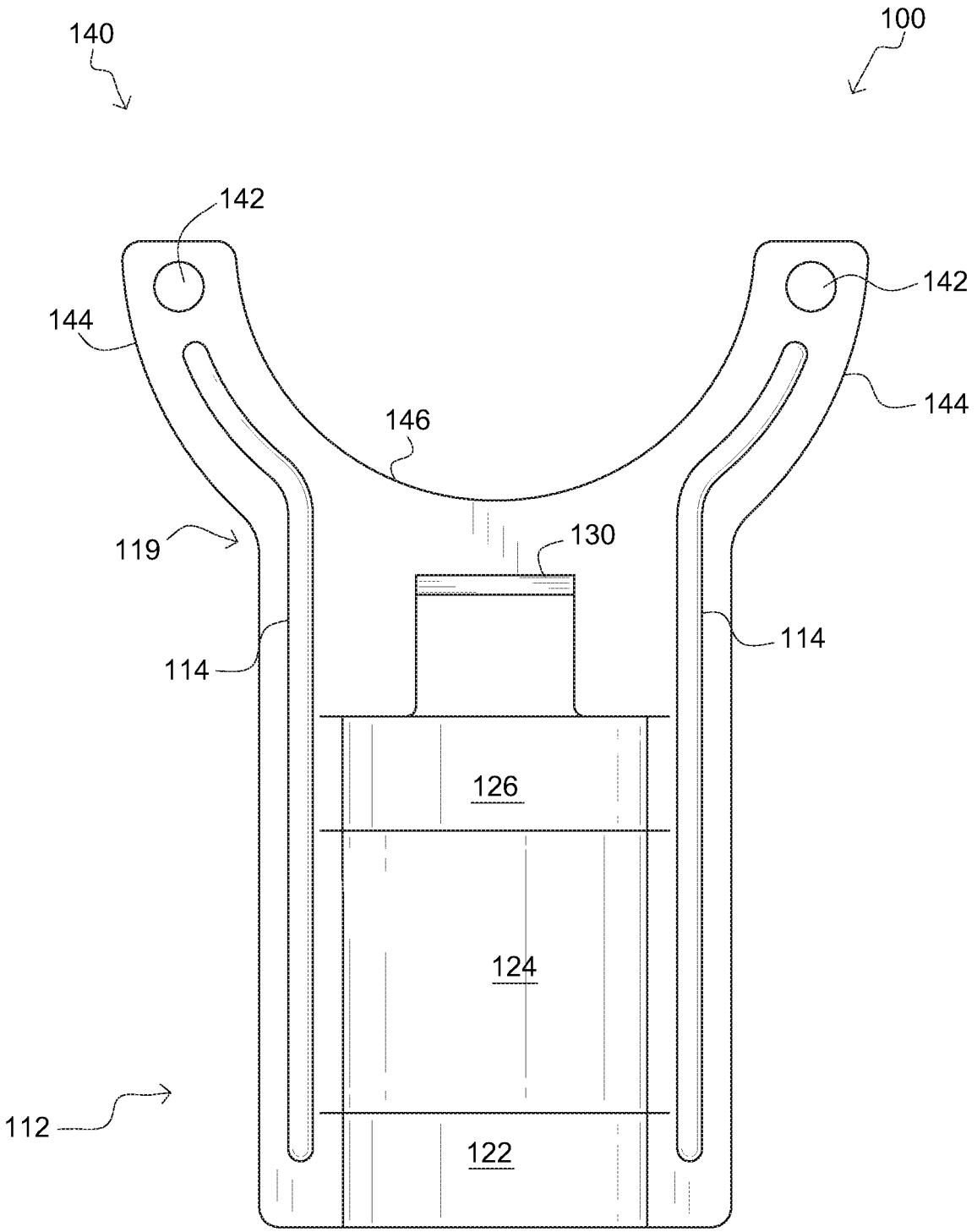
FIG. 3 is a rear elevational view of a stamped pin cap according to one embodiment of the invention.
Figure 4:
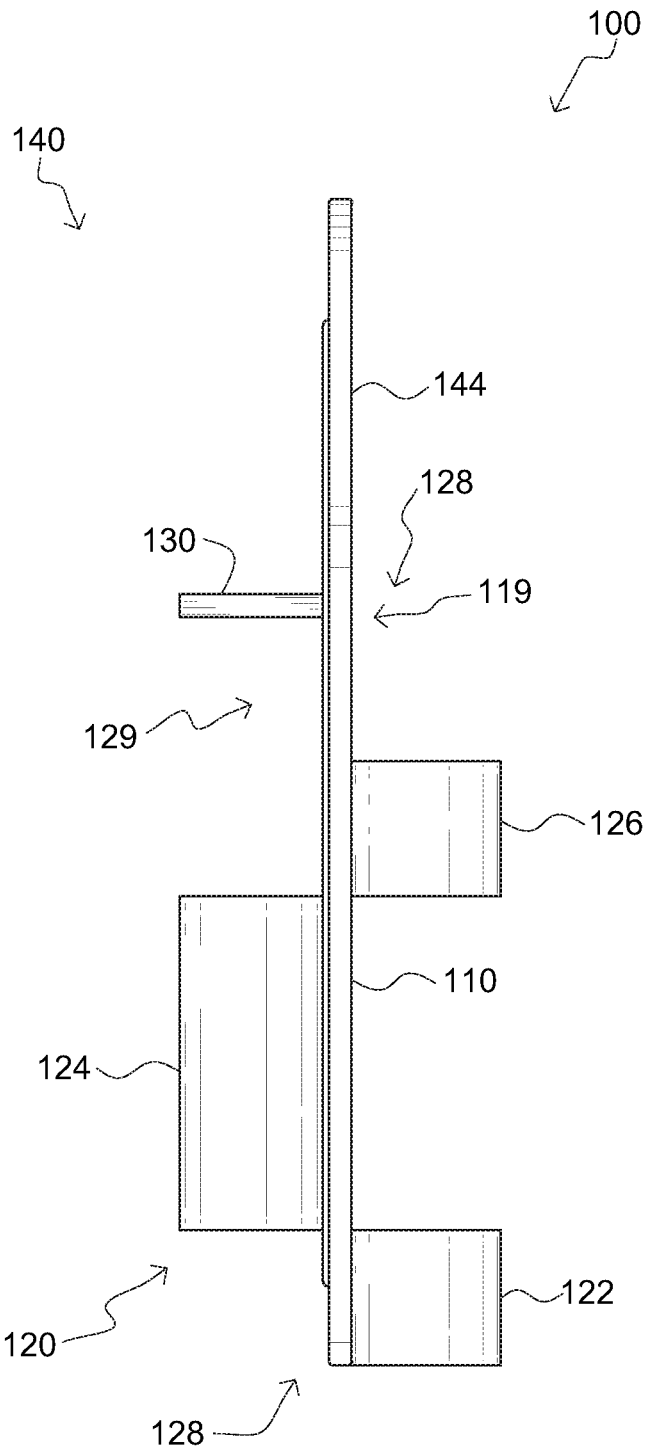
FIG. 4 is a side elevational view of a stamped pin cap according to one embodiment of the invention.
Figure 5:
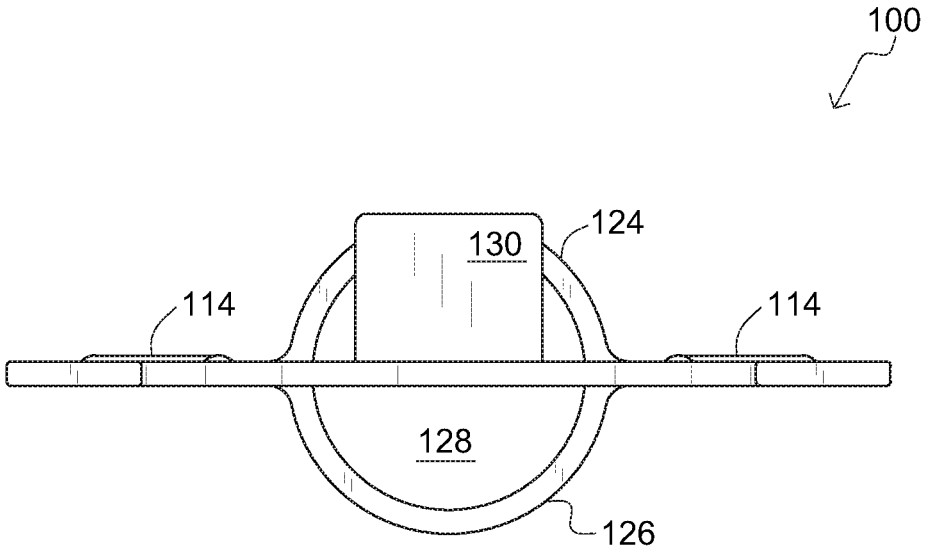
FIG. 5 is a top plan view of a stamped pin cap according to one embodiment of the invention.
Figure 6:
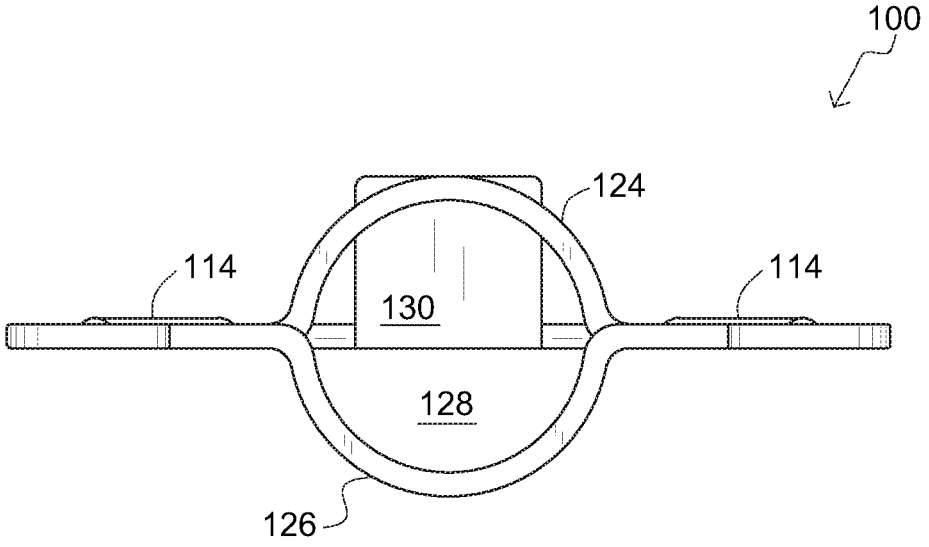
FIG. 6 is a bottom plan view of a stamped pin cap according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIGS. 1-6 are various views of a stamped pin cap (also known as "screed chairs") according to one embodiment of the invention. There is shown a stamped pin cap 100 for use with reinforcing bars. The stamped pin cap includes a cap frame 110 having a pair of reinforcing grooves 114 extending along the frame within which is disposed a stamped mount 120. The stamped mount 120 is disposed within a bottom region 112 of the cap frame 110 and includes three adjacent channel guides that are bands 122, 124, 126 alternately protruding laterally from the frame thereby forming a channel 128 therebetween through which a reinforcing bar may be disposed. At a top portion 129 of the channel 128 there is a stop flange 130 that protrudes laterally from the frame 110 such that a reinforcing bar disposed through the channel is prevented from further travel therethrough. Extending from a top region 119 of the frame 110 is a cradle 140 that is shaped to receive and confine a member therein under gravity.

There are a pair of holes 142 through the cradle at opposite arms 144 thereof such that coupling shafts may be disposed therethrough. The illustrated cradle 140 is shaped with a semi-circular interior surface 146 to receive a circular pipe such that a pipe having a circular cross section may nestle therein.

The illustrated cap frame 110 provides support structure for the mount 120, stop flange 130, and cradle 140. The illustrated cap frame is shaped as a pair of parallel supports extending along the length of the channel 128 and thereby coupling each of the bands 122, 124, 126 together and coupling the mount to each of the stop flange 130 and cradle 140. The illustrated cap frame is symmetrical, but it is understood that there are plethoric shapes, configurations and orientations of such frames that would still provide the benefits thereof and that such frames may also display various decorative shapes and decorative structures thereon as desired. Indeed, as a non-limiting example, there may be a frame that only frames one side of the bands and that includes a stamped logo of a particular company extending outwardly therefrom. Such a frame would be asymmetrical, as compared to the illustrated frame, and would include a decorative structure.

The illustrated mount 120 operates to couple to a rebar or other similar structure and to stay mounted thereon. The illustrated bands 122, 124, 126 cooperate together with the stop flange 130 to firmly secure the device to an end of a rebar, or other similar structure, under the presence of gravity, such that typical jostling of the device during operation does not knock the device off the rebar. The illustrated bands 122, 124, and 16 are not all the same height, as the middle band 124 is taller than the other two, which improves the stability thereof. As the illustrated mount is stamped without creating lateral overlap between the bands (See FIGS. 2 and 3), the alternating bands, together as a triad, trap the rebar within the channel 128 such that the mount will not fall off the rebar if tipped one way or the other. While the illustrated mount includes a series of alternating bands that together form a channel, a mount may include additional or alternative structures, such as but not limited to fold-over tangs that cooperate to form a channel, accordion-style structures that are punched/folded/stamped into a channel shape, a stamped/folded zig-zag structure of material with a hole in the middle, and various other wrapped/folded structures, such as but not limited to a wrapped/folded triangle of material at a base of a device.

The illustrated stop flange 130, shown in FIG. 1 as dotted lines as it would otherwise be obscured by the cradle, provides a stable rest against which a tip of a rebar, or other similar structure, rests when the device is installed thereon. The stop flange may also, advantageously, provide a support for coupling the device to another structure (See FIGS. 7 and 8 as non-limiting examples). While the illustrated stop flange (tang) is a simple tab of material that has been punched and folded outwardly to extend at about a 90 degree angle from the frame, various other structures for such a stop flange are contemplated herein, including but not limited to a double-tang sticking out both sides, no tang/tab at all (e.g. just an edge of material from which the top-most band was stamped), and/or tabs having shapes and orientations different from the illustrated rectangular tab extending at a right angle, such as but not limited to a triangular tab extending upwardly at an angle greater than 90 degrees from the frame, a multi-tabbed stop flange that may include tabs of different shapes extending at different angles, and/or wherein the tab/flange is created not by punching out the tab from the material, but from folding the material over on itself to form the frame, the cradle, and/or the mount.

The illustrated cradle 140 provides coupling, under the influence of gravity, for the device to another structure, such as but not limited to a construction pipe, such as but not limited to those used in the installation of concrete. The illustrated cradle is shaped to receive such a circular member and trap the same, under the influence of gravity, therein. Accordingly, wherein a plurality of such devices are installed within a grid of rebars, a grid of pipe may be laid there-across, such as but not limited to for the purposes of providing a predetermined leveling structure for proper leveling/grading of wet concrete. While the illustrated cradle is a pair of arms cooperating to form a semi-circular receiving member, other variations of the cradle are contemplated, including but not limited to plethoric different shapes, orientations, and sizes that may match up to other additional structures that may be different from inch-and-a-quarter construction pipe. AS a non-limiting example. There may be a cradle having arms extending horizontally in a flat configuration to match with a flat bar or 2×4 piece of lumber. Such a flat cradle may or may not have upwardly extending arms at the ends to form boundaries within which to trap the additional structure. Further, the illustrated holes may positioned at different places on the cradle than those illustrated, there may be more or less than such holes, and one may put other things besides screws in them. Further, the holes need not even be complete holes, as they may instead be spikes, clips, snaps, nails, staples, or the like or other structures that couple to another structure.

In one non-limiting embodiment, there is a pin cap that is stamped out so that it sits over a rebar. It has a cradle to hold a pipe and a tang (stop flange) sticking out the side so it can support a 2×4 piece of lumber or other similar structure. The pin cap may include a cradle having one or more screw-holes through arms thereof, a tang disposed under the cradle and extending outwardly to form a stop that prevents further vertical travel upward through a channel in the device, a mount shaped to couple to an end of a rebar, and a frame coupling each to the other.

Figure 7:
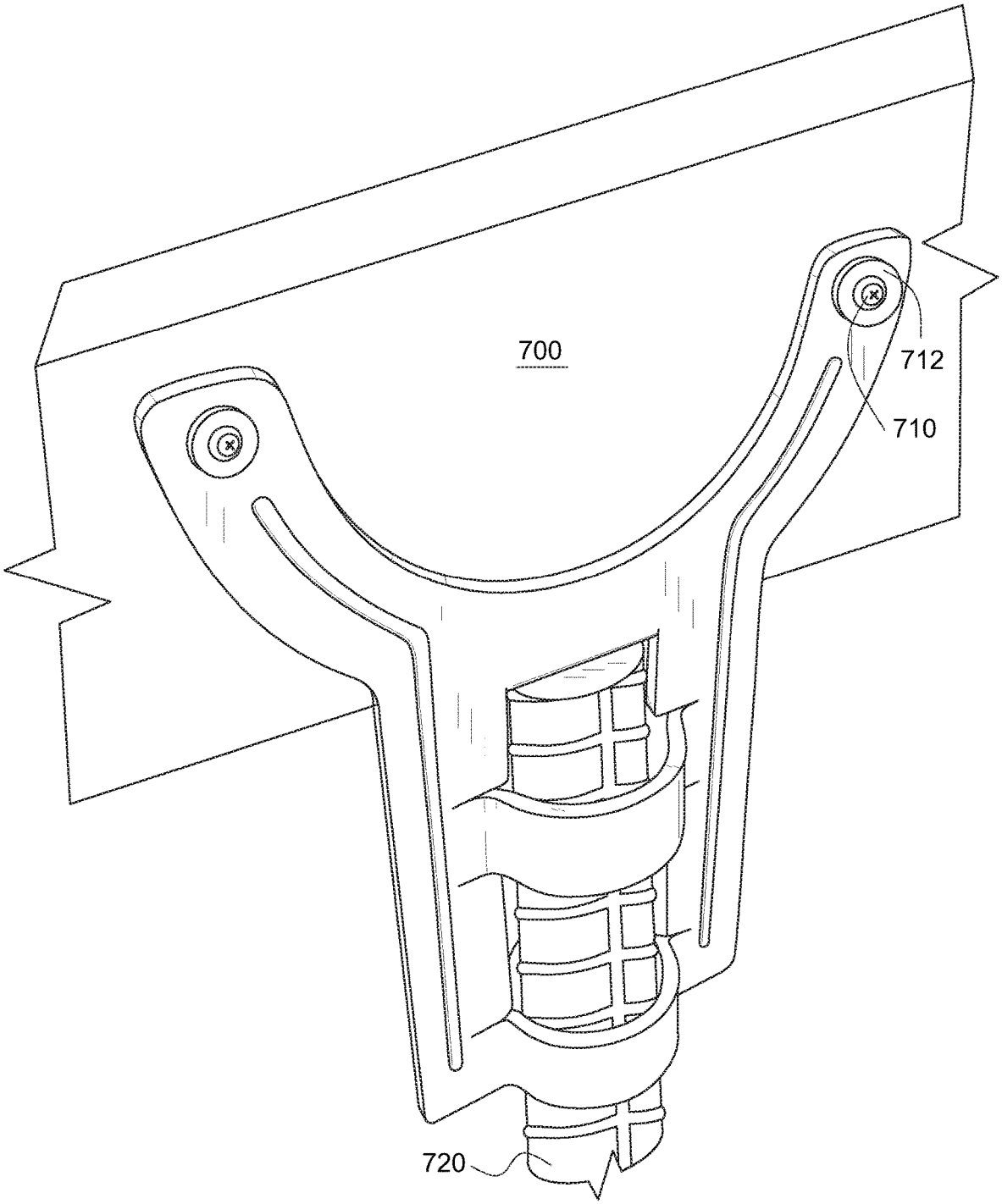
FIG. 7 is a front perspective view of a stamped pin cap mounted on a rebar and coupled to a 2×4 piece of lumber according to one embodiment of the invention.
Figure 8:
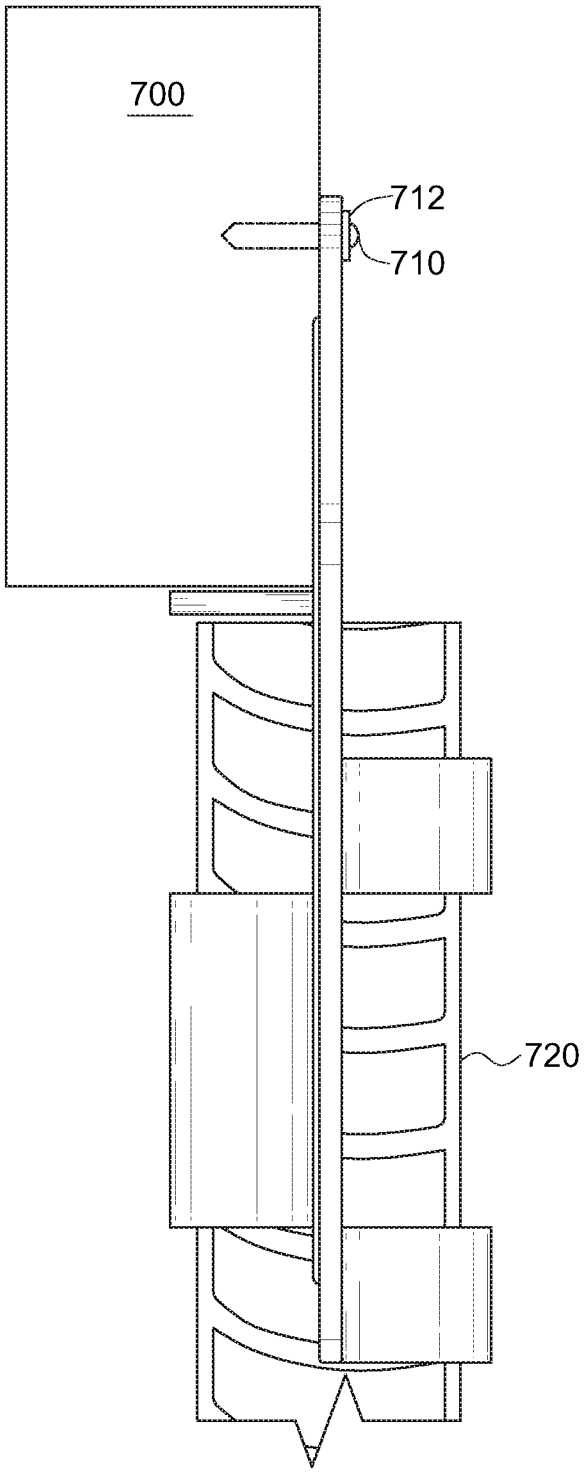
FIG. 8 is a side elevational view of a stamped pin cap mounted on a rebar and coupled to a 2×4 piece of lumber according to one embodiment of the invention.

FIGS. 7 and 8 are various views of a stamped pin cap mounted on a rebar and coupled to a 2×4 piece of lumber according to one embodiment of the invention. There is shown a device mounted on an end of a reinforcing bar (rebar) 720 and also mounted to a piece of lumber 700 that is resting on the stop flange of the device. Screws 710 extend through washers 712 and through holes in the device to thereby couple the lumber to a top portion (cradle portion) of the device.

In the illustrated embodiment, the device is able to be coupled to a construction pipe as well as a piece of lumber or other similar structure. This allows for the device to serve multiple purposes with a single form of manufacture, thereby decreasing the need for on-hand inventory of multiple variations of such devices for use in construction.

Figure 9:
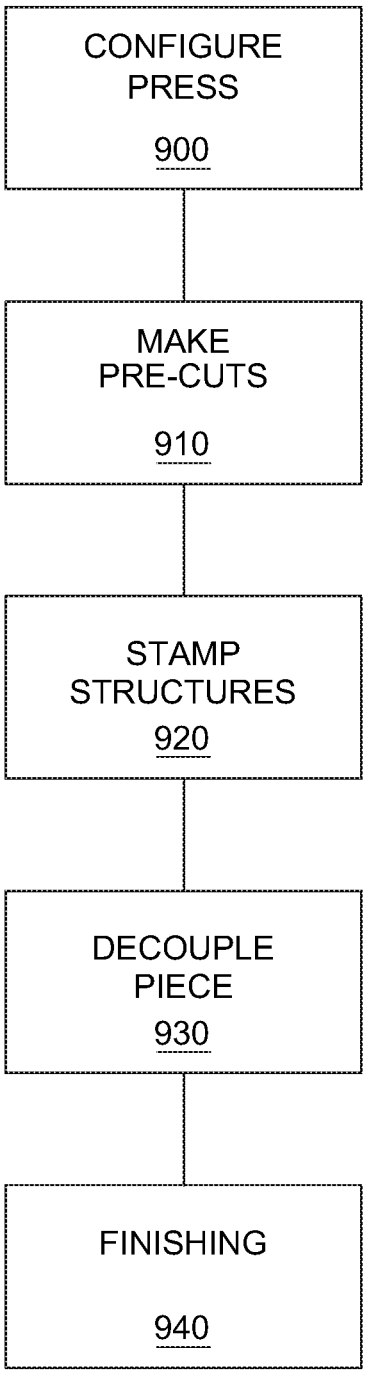
FIG. 9 is a flowchart illustrating a method of manufacturing a stamped pin cap according to one embodiment of the invention.

FIG. 9 is a flowchart illustrating a method of manufacturing a stamped pin cap for use in construction according to one embodiment of the invention. There is shown a step of configuring a press 900 followed by making any pre-cuts 910 in material to be stamped that may be needed before stamping such material. The material is then stamped 920 in a sequence that stamps out the proper structures as desired, including those that were precut. The device(s) are then decoupled 930 from each other and then finished 940.

The illustrated configuring step 900 may include forming, casting, molding, shaping or otherwise creating and placing various stamp dies and configuring stamping tools within a stamping assembly to create the desired stamps, folds, cuts, and shapes desired within the stampable material. Such a configuring step may include determining an order of sequential stamping that is to occur to generate the desired stamped product. One of ordinary skill in the art would recognize how the various stamping/cutting/folding/etc. operations made during manufacturing would impact each other and the final product in making such a sequential determination, as well as selecting the appropriate stamps/dies/cuts/etc. to utilize in the process. Such a stamping assembly may be configured to perform the stamping method or manufacture in series along the strip of stampable material such that a plurality of pin caps may be stamped therefrom. Such may also include selecting the material which is to be stamped, generally a strip of ductile material of predetermined thickness, such as but not limited to strips/rolls of sheet metal.

As non-limiting example, there may be one or more punch dies used to punch out holes as shown in element 142 of FIGS. 1-6, there may be one or more beveled punches used to cut and bend under force the stop flange illustrated as element 130 of FIGS. 1-6, there may be one or more dies shaped to stamp grooves such as those illustrated as element 114 in FIGS. 1-6, there may be one or more curved dies shaped to press and cut the bands 122, 124, and 126 illustrated in FIGS. 1-6, and there may be one or more dies that stamp-cut the arms 144 and frame 110 of the device as illustrated in FIG. 1-6 herein.

The illustrated precutting step 910 may include making one or more cuts before performing a stamping step, the cuts positioned and oriented to facilitate stamping. As a non-limiting example, such cuts may be made at any of the dotted or solid lines in FIG. 10 within the strip of material 1000. Such cuts may be performed using blades, saws, water cutting, or the like or combinations thereof, depending upon the properties of the materials and/or the properties of the stamping/cutting tools used therewith. The cuts may be made all the way through the material or may merely score the material. The cuts may extend in a line or may form an array of perforation.

The illustrated stamping step 920 may include stamping one or more of the following into a strip of stampable material, thereby forming a pin cap section: a plurality of alternating channel guides at a bottom end of a predefined pin cap; a stop flange at a top end of a predefined channel formed by predefined alternating channel guides; a cradle at a top end of a predefined pin cap; and a frame. The stamping step may also include stamping a hole through an arm of the cradle through which a coupling shaft may be disposed; and/or stamping a reinforcing groove through the frame.

As stamped, the cradle may be shaped to nestle a circular pipe therein (See FIGS. 1-6). As stamped, a center channel guide may be taller than each channel guide adjacent thereto (see band 124 as compared to bands 122 and 126 FIGS. 1-6).

Stamping steps may include operation of various stamping tools, such as but not limited to stamping of stamp dies, cutters, folding devices/machines and the like and combinations thereof. Accordingly, there may be a step of stamping channel guides which includes a step of folding a pin cap to bring channel guides adjacent to each other.

The illustrated decoupling step 930 may include decoupling a pin cap section from the strip of stampable material, thereby forming the pin cap. Such may be performed through a final stamp and/or cut that cuts the pin cap out of the strip of material.

The illustrated finishing step 940 may include one or more steps of cleaning, deburring, sanding, coating, imprinting, annealing, anodizing, or otherwise treating the stamped pin cap as desired to alter its characteristics to those of a finished product.

In one non-limiting embodiment there is a method of manufacturing a pin cap for use in construction comprising the steps of: stamping each of the following into a strip of stampable material, thereby forming a pin cap section: a channel; a stop flange at a top end of the channel; a cradle near the stop flange and opposite the channel; and a frame disposed about the channel; and decoupling the pin cap section from the strip of stampable material, thereby forming the pin cap.

Such a method may further comprise the step of stamping a hole through an arm of the cradle through which a coupling shaft may be disposed; the step of stamping a reinforcing groove through the frame; and/or the step of making one or more cuts before performing a stamping step, the cuts positioned and oriented to facilitate stamping.

Advantageously, the illustrated method requires no welding, use of molds, or other expensive manufacturing tools/techniques and thus may be manufactured quickly and inexpensively relative to other pin caps.

Figure 10:
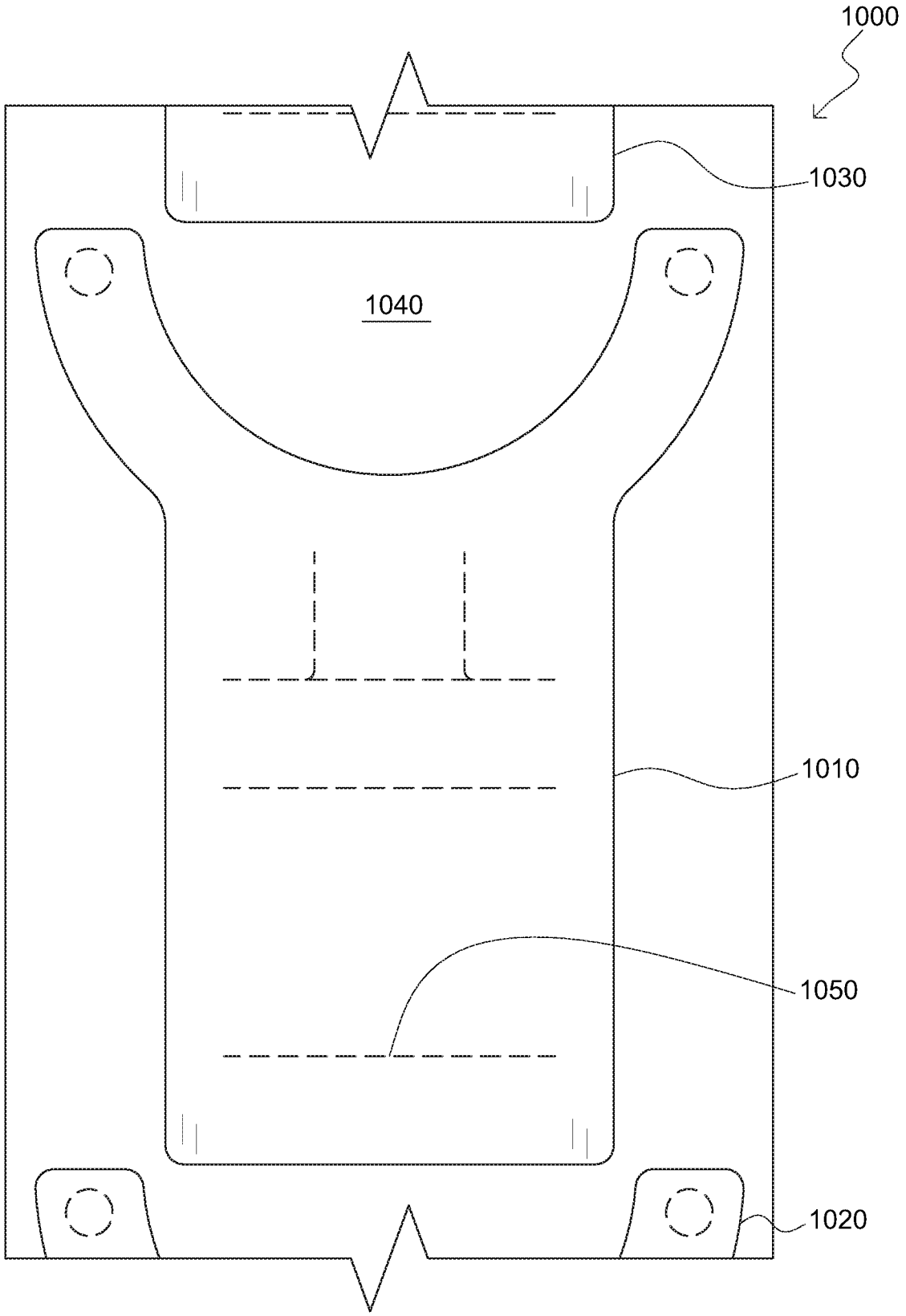
FIG. 10 is a front view of a strip of stampable material from which a series of stamped pin caps may be manufactured, according to one embodiment of the invention.

FIG. 10 is a front view of a strip of stampable material from which a series of stamped pin caps may be manufactured from a strip of stampable material, according to one embodiment of the invention. The material may be selected from materials that are able to be stamped, such as but not limited to metals and plastics, generally strips/rolls of sheet metal. The illustrated strip of material 1040 includes a full view of intended stamping lines 1010 and 1050 within the strip of stampable material 1000 including those for adjacent pin caps 1020 and 1030 to be stamped therefrom. Stamping, cutting may occur along any of the dotted and/or continuous lines within the strip to thereby form the final product. The illustrated continuous lines within the strip of stampable material may be the final stamp to cut the product out of the strip so that it is ready for finishing.

Figure 11:
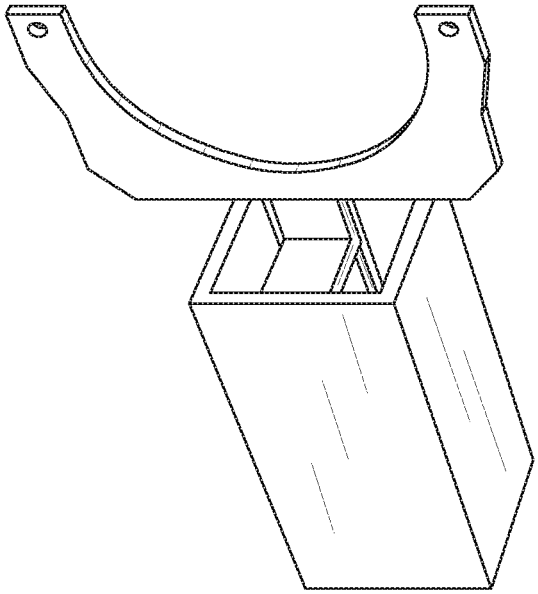
FIG. 11 is a perspective view of a pin cap according to one embodiment of the invention.

FIG. 11 is a perspective view of a pin cap according to one embodiment of the invention. There is shown a cap frame/mount having a rectangular cross section. The pin cap may be a stamped pin cap.

Figure 12:
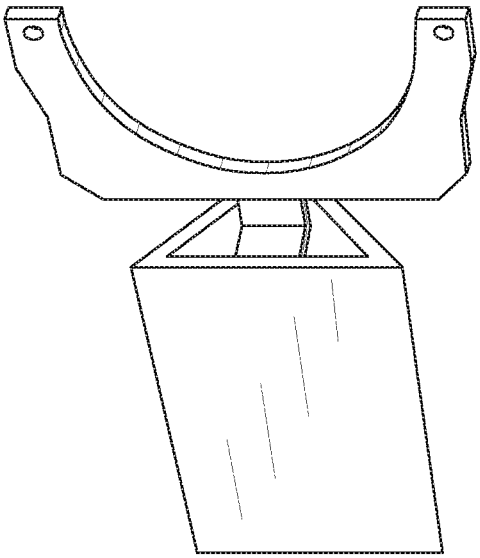
FIG. 12 is a perspective view of a pin cap according to one embodiment of the invention.

FIG. 12 is a perspective view of a pin cap according to one embodiment of the invention. There is shown a cap frame/mount having a triangular cross section. The pin cap may be a stamped pin cap.

Figure 13:
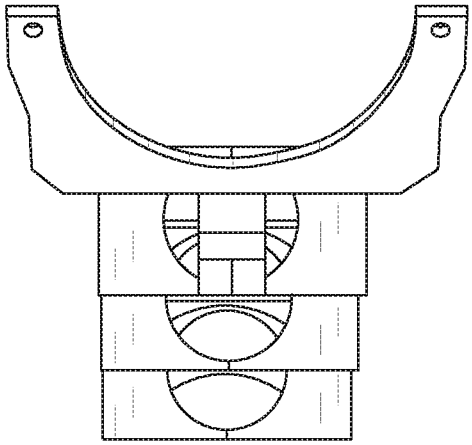
FIG. 13 is a perspective view of a pin cap according to one embodiment of the invention.

FIG. 13 is a perspective view of a pin cap according to one embodiment of the invention. There is shown a cap frame/mount having a zig-zag shape. The pin cap may be a stamped pin cap.

Figure 14:
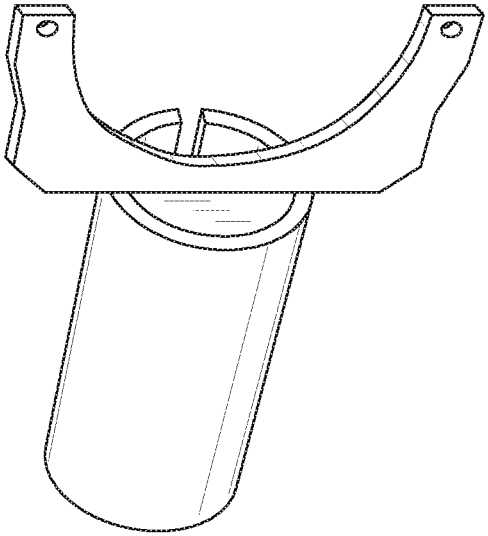
FIG. 14 is a perspective view of a pin cap according to one embodiment of the invention.

FIG. 14 is a perspective view of a pin cap according to one embodiment of the invention. There is shown a cap frame/mount having a circular cross section. The pin cap may be a stamped pin cap.

Figure 15:
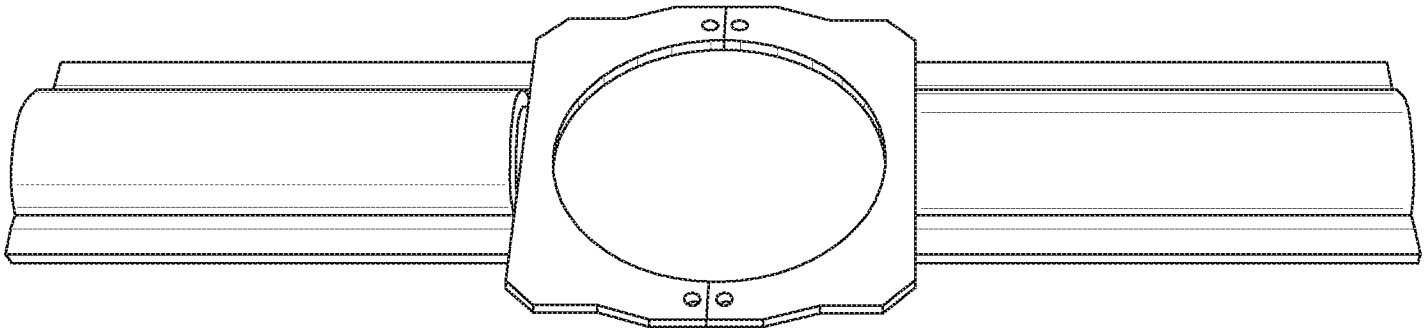
FIG. 15 is a perspective view of a partially manufactured pin cap according to one embodiment of the invention.

FIG. 15 is a perspective view of a partially manufactured pin cap according to one embodiment of the invention. The pin cap has yet to be folded over to form the final pin cap shape wherein there is a mount having a circular cross-section bounded by a simple, straight frame. The material folds over onto itself at fold lines that are between the paired apertures, thereby also forming the cradle. The pin cap may be a stamped pin cap.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A stamped pin cap for use with reinforcing bars; comprising:

a. a cap frame;

b. a stamped mount disposed within a bottom region of the cap frame and including three bands alternately protruding laterally from the cap frame thereby forming a channel there between through which a reinforcing bar may be disposed;

c. a stop flange disposed at a top portion of the channel and protruding laterally from the cap frame such that a reinforcing bar disposed through the channel is prevented from further travel therethrough, and d. a pair of arms extending from a top region of the cap frame opposite the stamped mount and extending away from the stamped mount and the stop flange, the pair of arms together forming cradle extending upwardly from a top region of the cap frame and wherein far ends of the pair of arms are spaced apart from each other and oriented away from each other.

2. The cap of claim 1, further comprising a pair of holes through the cradle at opposite arms thereof such that coupling shafts may be disposed therethrough.

3. The cap of claim 1, further comprising a first reinforcing groove extending along the frame and continuing along a first arm of the pair of arms, and a second reinforcing groove extending along the frame spaced from the first reinforcing groove and continuing along a second arm of the pair of arms.

4. The cap of claim 1, wherein the three bands are adjacent to each other and are at a bottom-most portion of the cap.

5. The cap of claim 1, wherein the pair of arms are coplanar with the cap frame.

* * * * *